US010699519B2

(12) United States Patent
Oyama et al.

(10) Patent No.: US 10,699,519 B2
(45) Date of Patent: Jun. 30, 2020

(54) INFORMATION PROCESSOR, GAME PROGRAM, AND GAME CONTROL METHOD

(71) Applicant: Universal Entertainment Corporation, Koto-Ku, Tokyo (JP)

(72) Inventors: Masaki Oyama, Tokyo (JP); Atsushi Kumita, Tokyo (JP); Toshikazu Jinnouchi, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 21 days.

(21) Appl. No.: 16/127,710

(22) Filed: Sep. 11, 2018

(65) Prior Publication Data

US 2019/0080552 A1 Mar. 14, 2019

(30) Foreign Application Priority Data

Sep. 13, 2017 (JP) ..... 2017-175920

(51) Int. Cl.
*G07F 17/32* (2006.01)
*G07F 17/34* (2006.01)

(52) U.S. Cl.
CPC ..... *G07F 17/3213* (2013.01); *G07F 17/3244* (2013.01)

(58) Field of Classification Search
None
See application file for complete search history.

(56) References Cited

U.S. PATENT DOCUMENTS

2016/0063803 A1 3/2016 Inamura et al.
2017/0337772 A1* 11/2017 Yamamori ..... G07F 17/3262

FOREIGN PATENT DOCUMENTS

WO 2016136749 A1 9/2016

* cited by examiner

*Primary Examiner* — Lawrence S Galka
(74) *Attorney, Agent, or Firm* — Potomac Law Group, PLLC; Kenneth Fagin

(57) ABSTRACT

An information processor includes: a display configured to display a symbol display area on which symbols are displayable; and a controller programmed to execute the processes of: (1a) randomly determining symbols to be displayed outside a symbol display area; (1b) displaying, outside the symbol display area, the symbols determined in the process (1a); (1c) randomly determining a combination of symbols to be displayed in the symbol display area; (1d) displaying, in the symbol display area, the combination of the symbols determined in the process (1c); (1e) when a predetermined condition is satisfied, displaying a predetermined number of symbols out of the symbols displayed outside the symbol display area in the process (1b) in the symbol display area, in accordance with the satisfied predetermined condition; and (1f) after the process (1e), awarding a benefit in accordance with a combination of the symbols displayed in the symbol display area.

7 Claims, 13 Drawing Sheets

FIG.5

SYMBOL ARRAYS ON VIDEO REELS

| | REEL 1 | REEL 2 | REEL 3 | REEL 4 | REEL 5 |
|---|---|---|---|---|---|
| 0 | HEART | 9 | CHERRY | 9 | KING |
| 1 | CHERRY | JACK | KING | JACK | ACE |
| 2 | 7 | HEART | 9 | WILD | BELL |
| 3 | JACK | 7 | ACE | 9 | KING |
| 4 | KING | 10 | BELL | JACK | WATERMELON |
| 5 | WATERMELON | 9 | 10 | HEART | WATERMELON |
| 6 | 10 | ACE | WATERMELON | KING | QUEEN |
| 7 | BELL | BELL | 10 | JACK | HEART |
| 8 | JACK | JACK | CHERRY | 10 | JACK |
| 9 | 9 | WATERMELON | 10 | BELL | 9 |
| 10 | ACE | 9 | WATERMELON | 9 | CHERRY |
| 11 | JACK | CHERRY | JACK | ACE | 10 |
| 12 | ACE | ACE | KING | ACE | 7 |
| 13 | BELL | QUEEN | HEART | 9 | ACE |
| 14 | KING | 9 | 7 | QUEEN | JACK |
| 15 | QUEEN | KING | 10 | 7 | 9 |
| 16 | HEART | WILD | 7 | CHERRY | KING |
| 17 | JACK | ACE | QUEEN | HEART | JACK |
| 18 | 10 | QUEEN | 10 | ACE | ACE |
| 19 | 9 | WATERMELON | WILD | KING | BELL |
| 20 | 9 | 10 | QUEEN | WATERMELON | QUEEN |
| 21 | CHERRY | 9 | 10 | 10 | ACE |
| 22 | JACK | QUEEN | CHERRY | BELL | 9 |
| 23 | 10 | CHERRY | ACE | 9 | WATERMELON |
| 24 | WATERMELON | ACE | QUEEN | 10 | 10 |
| 25 | JACK | 9 | QUEEN | CHERRY | ACE |
| 26 | | 7 | BELL | KING | CHERRY |
| 27 | | 10 | 9 | | QUEEN |
| 28 | | BELL | | | ACE |
| 29 | | | | | HEART |
| 30 | | | | | 10 |
| 31 | | | | | BELL |
| 32 | | | | | ACE |
| 33 | | | | | KING |
| 34 | | | | | |

FIG.6

SYMBOL COMBINATION TABLE

| SYMBOL | GRAPHICS | 1 | 2 | 3 | 4 | 5 |
|---|---|---|---|---|---|---|
| WILD | | 0 | 0 | 0 | 0 | 0 |
| 7 | | 0 | 0 | 50 | 300 | 1000 |
| HEART | | 0 | 0 | 35 | 200 | 800 |
| BELL | | 0 | 0 | 30 | 100 | 500 |
| WATERMELON | | 0 | 0 | 20 | 50 | 300 |
| CHERRY | | 0 | 0 | 15 | 35 | 300 |
| ACE | A | 0 | 0 | 10 | 30 | 200 |
| KING | K | 0 | 0 | 10 | 20 | 200 |
| QUEEN | Q | 0 | 0 | 10 | 15 | 100 |
| JACK | J | 0 | 0 | 10 | 15 | 100 |
| TEN | 10 | 0 | 0 | 5 | 15 | 100 |
| NINE | 9 | 0 | 0 | 5 | 10 | 100 |

INFORMATION PROCESSOR, GAME PROGRAM, AND GAME CONTROL METHOD

CROSS-REFERENCES TO RELATED APPLICATIONS

This Application is Entitled to the benefit of Japanese Patent Application No. 2017-175920 filed on Sep. 13, 2017.

BACKGROUND OF THE INVENTION

1. Field of the Invention

The present invention relates to an information processor, a game program, and a game control method.

2. Description of Related Art

There have been various games played on stationary home game consoles, game machines installed in facilities, and information processors such as smartphones. For example, there is a slot game which is arranged such that it is played by betting gaming media (e.g., in-game currencies) and a benefit (payout) is awarded in accordance with betted gaming media and a combination of symbols displayed on a screen (i.e., a game result). Such a game is basically enjoyed by repeating a game cycle (unit game) from the start of the game to the acquisition of a game result (Patent Literature 1 (International Publication No. WO2016/136749A1)).

In the slot game, after reels on which symbols are displayed are scrolled, symbols which are randomly selected are stopped in a frame (symbol display area) displayed on a display or the like. A benefit is awarded in accordance with the combination of the symbols stopped in the frame.

In such a slot game, the order of symbols displayed on the surfaces of the reels is typically determined in advance.

In the meanwhile, there is an additional arrangement in which shift to a free game (a slot game which does not require additional betting) occurs when a predetermined condition is satisfied in the base game, and reels on which the order of symbols is different from that in the base game are used in the free game after the shifting (Patent Literature 2 (Specification of Publication of U.S. Patent Application No. 2016063803)).

In this free game, however, the reels on which the symbols are arranged in the same order as in the base game are used in a game cycle (unit game) from the start of the game to the acquisition of the game result.

Technical Problem

In the slot game above, the arrangement of the symbols in the frame remains the same during the scroll of the reels or after the scroll of the reels stops and the symbols are stopped in the frame. For this reason, the slot game tend to be monotonous.

An object of the present invention is to provide an information processor, a game program, and a game control method, which resolve the monotony of the game and induces players to continue a particular game.

SUMMARY OF THE INVENTION

The present invention relates to an information processor comprising: a display configured to display a symbol display area on which symbols are displayable and a controller programmed to execute game processes of: (1a) randomly determining symbols to be displayed outside the symbol display area of the display; (1b) displaying, outside the symbol display area of the display, the symbols determined in the process (1a); (1c) randomly determining a combination of symbols to be displayed in the symbol display area of the display; (1d) displaying, in the symbol display area of the display, the combination of the symbols determined in the process (1c); (1e) when a predetermined condition is satisfied, displaying a predetermined number of symbols out of the symbols displayed outside the symbol display area in the process (1b) in the symbol display area, in accordance with the satisfied predetermined condition; and (1f) after the process (1e), awarding a benefit in accordance with a combination of the symbols displayed in the symbol display area.

When a combination of the symbols determined in the symbol random determination process (1a) is displayed in the symbol display area of the display and satisfies the predetermined condition, a predetermined number of symbols selected from the symbols displayed outside the symbol display area are displayed in the symbol display area. In other words, when the predetermined condition is satisfied, the predetermined number of symbols displayed outside the symbol display area are added to the symbol display area based on which whether to award a benefit in accordance with a combination of symbols is determined. As a result, the unit game is executed while a symbol which may be added to the symbol display area based on which whether to award a benefit is determined is displayed outside the symbol display area. When the predetermined condition is satisfied, it is possible to display a game result which takes account of the symbol displayed outside the symbol display area. This makes it possible to avoid monotony in the game play. Furthermore, when the symbol displayed outside the symbol display area in the out-of-area display symbol random determination process (1a) is advantageous for the awarding of a benefit, the player is induced to continue the game after the process (1c).

The present invention further relates to an information processor comprising: a display configured to display a symbol display area having a matrix in which symbols are rearrangeable; a storage unit configured to store a symbol random determination table in which the probability of rearrangement of each of the symbols is defined; and a controller which is programmed to execute, as a unit game, processes of: (2a) randomly determining symbols to be displayed outside the symbol display area of the display; (2b) displaying, outside the symbol display area of the display, the symbols determined in the process (2a); (2c) randomly determining a combination of symbols which are to be rearranged in the symbol display area of the display, based on the symbol random determination table; (2d) displaying, in the symbol display area of the display, the combination of the symbols determined in the process (2c); (2e) when the combination of the symbols displayed in the symbol display area of the display satisfies a predetermined condition, rearranging a predetermined number of symbols out of the symbols displayed outside the symbol display area in the process (2b) in the symbol display area, in accordance with the satisfied predetermined condition; and (2f) after the process (2e), awarding a benefit in accordance with a combination of the symbols displayed in the symbol display area.

When a combination of the symbols determined in the symbol random determination process (2a) is displayed in the matrix symbol display area of the display and satisfies the predetermined condition, a predetermined number of symbols selected from the symbols displayed outside the symbol display area are displayed in the symbol display area. In other words, when the predetermined condition is satisfied, the predetermined number of symbols displayed outside the symbol display area are added to the symbol display area based on which whether to award a benefit in accordance with a combination of symbols is determined. As a result, the unit game is executed while a symbol which may be added to the symbol display area based on which whether to award a benefit is determined is displayed outside the symbol display area. When the predetermined condition is satisfied, it is possible to display a game result which takes account of the symbol displayed outside the symbol display area. This makes it possible to avoid monotony in the game play.

In the information processor described above of the present invention, the controller is configured to further execute a process of: when the combination of the symbols rearranged in the symbol display area in the process (2d) does not satisfy the predetermined condition, executing a next unit game except the processes (2a) and (2b), while the symbols displayed outside the symbol display area in the process (2b) are kept displayed.

According to the arrangement above, when the unit game is executed and the predetermined condition is not satisfied, the next unit game is executed while the symbols displayed outside the symbol display area in the process (2b) are displayed. In other words, the symbols displayed outside the symbol display area are used in the next unit game. With this arrangement, when the symbols displayed outside the display area are advantageous for the awarding of a benefit, the player is induced to execute the next unit game.

In the above-described information processor of the present invention, the symbol display area is arranged so that columns and stages intersect with one another in a matrix manner, and the controller executes a process in which, in the process (2b), the symbols determined in the out-of-area display symbol random determination process (2a) are displayed above the respective columns, the symbols are scrolled along the respective columns and rearranged in the respective columns in the process (2d), and if in the process (2e) the combination of the symbols rearranged in the symbol display area satisfies the predetermined condition, the symbols forming the combination satisfying the predetermined condition are deleted and all symbols rearranged above the deleted symbols and symbols displayed above the columns in which the deleted symbols are rearranged are moved downward in a sliding manner.

According to the arrangement above, the unit game is executed while symbols, which may be rearranged in the symbol display area which is arranged so that columns and stages intersect with one another in a matrix manner and based on which whether to award a benefit is determined, are displayed above the respective columns. When the combination of the symbols rearranged in the symbol display area satisfies the predetermined condition, the symbols forming the combination satisfying the predetermined condition are deleted, and all symbols rearranged above the deleted symbols and symbols displayed above the columns in which the deleted symbols are rearranged are moved downward in a sliding manner. As a result, when the predetermined condition is satisfied, the symbols displayed outside the symbol display area are arranged in the symbol display area based on which whether to award a benefit is determined. Because whether to award a benefit is determined based on a game result which takes account of the symbols displayed outside the symbol display area, it is possible to avoid monotony in the game play.

The present invention relates to an information processor comprising: a display configured to display a symbol display area in which symbols are rearrangeable and columns and stages intersect with one another in a matrix manner; a storage unit configured to store a symbol random determination table in which the probability of rearrangement of each of the symbols is defined; and a controller which is programmed to execute, as a unit game, processes of: (3a) randomly determining symbols to be displayed outside the symbol display area of the display; (3b) displaying, above the respective columns, the symbols determined in the process (3a); (3c) randomly determining a combination of symbols which are to be rearranged in the symbol display area of the display, based on the symbol random determination table; (3d) scrolling the symbols along the respective columns and then rearranging, in the symbol display area of the display, the combination of the symbols determined in the process (3c) along the respective columns; (3e) when a predetermined game condition is satisfied, causing a predetermined number of symbols corresponding to the predetermined game condition to be selectable out of the symbols rearranged in the symbol display area in the process (3d), deleting all of the selected symbols, and moving all symbols rearranged above the deleted symbols and symbols displayed above the columns in which the deleted symbols are rearranged, downward in a sliding manner; and (3f) after the process (3e), awarding a benefit in accordance with a combination of the symbols displayed in the symbol display area.

According to the arrangement above, when the predetermined game condition is satisfied, symbols, the number of which corresponds to the predetermined game condition, are freely selectable from the symbols rearranged in the symbol display area. The selected symbols are deleted, and the symbols provided above the deleted symbols (including the symbols displayed above the columns) drop down. A benefit is awarded in accordance with a combination of symbols (including the dropped symbols) displayed in the symbol display area. This arrangement allows the player to consider which symbol should be deleted to rearrange the symbols in order to form a combination with which a benefit is awarded, with reference to the symbols displayed above the columns of the symbol display area.

In the above-described information processor of the present invention, the symbols include first benefit symbols and second benefit symbols, a benefit corresponding to a combination of the first benefit symbols is less valuable than a benefit corresponding to a combination of the second benefit symbols, and the symbols which are selected to be displayed outside the symbol display area in the out-of-area display symbol random determination process (2a) are the second benefit symbols.

According to this arrangement, because the symbols displayed outside the symbol display area on account of the out-of-area display symbol random determination process (2a) are second benefit symbols advantageous for the awarding of a benefit, the player is induced to continue the game after the process (2c).

The present invention relates to a game control method comprising the steps of (4a) randomly determining symbols to be displayed outside the symbol display area of the display; (4b) displaying, outside the symbol display area of the display, the symbols determined in the step (4a); (4c) determining a combination of symbols to be displayed in the symbol display area of the display; (4d) displaying, in the symbol display area of the display, the combination of the symbols determined in the step (4c); (4e) when a predetermined condition is satisfied, displaying a predetermined number of symbols out of the symbols displayed outside the symbol display area in the step (4b) in the symbol display area, in accordance with the satisfied predetermined condition; and (4f) after the step (4e), awarding a benefit in accordance with a combination of the symbols displayed in the symbol display area.

When a combination of the symbols determined in the symbol random determination step (4a) is displayed in the symbol display area of the display and satisfies the predetermined condition, a predetermined number of symbols selected from the symbols displayed outside the symbol display area are displayed in the symbol display area. In other words, when the predetermined condition is satisfied, the predetermined number of symbols displayed outside the symbol display area are added to the symbol display area based on which whether to award a benefit in accordance with a combination of symbols is determined. As a result, the unit game is executed while a symbol which may be added to the symbol display area based on which whether to award a benefit is determined is displayed outside the symbol display area. When the predetermined condition is satisfied, it is possible to display a game result which takes account of the symbol displayed outside the symbol display area. This makes it possible to avoid monotony in the game play. Furthermore, when the symbol displayed outside the symbol display area in the out-of-area display symbol random determination step is advantageous for the awarding of a benefit, the player is induced to continue the game after the step (4c).

The present invention relates to a game program causing a computer of a information processor to execute processes of: (5a) randomly determining symbols to be displayed outside the symbol display area of the display; (5b) displaying, outside the symbol display area of the display, the symbols determined in the process (5a); (5c) determining a combination of symbols to be displayed in the symbol display area of the display; (5d) displaying, in the symbol display area of the display, the combination of the symbols determined in the process (5c); (5e) when a predetermined condition is satisfied, displaying a predetermined number of symbols out of the symbols displayed outside the symbol display area in the process (5b) in the symbol display area, in accordance with the satisfied predetermined condition; and (5f) after the process (5e), awarding a benefit in accordance with a combination of the symbols displayed in the symbol display area.

When a combination of the symbols determined in the symbol random determination process (5a) is displayed in the symbol display area of the display and satisfies the predetermined condition, a predetermined number of symbols selected from the symbols displayed outside the symbol display area are displayed in the symbol display area. In other words, when the predetermined condition is satisfied, the predetermined number of symbols displayed outside the symbol display area are added to the symbol display area based on which whether to award a benefit in accordance with a combination of symbols is determined. As a result, the unit game is executed while a symbol which may be added to the symbol display area based on which whether to award a benefit is determined is displayed outside the symbol display area. When the predetermined condition is satisfied, it is possible to display a game result which takes account of the symbol displayed outside the symbol display area. This makes it possible to avoid monotony in the game play. Furthermore, when the symbol displayed outside the symbol display area in the out-of-area display symbol random determination process (5a) is advantageous for the awarding of a benefit, the player is induced to continue the game after the process (5c).

Advantageous Effects

The present invention is able to provide an information processor, a game program, and a game control method, which resolve the monotony of the game and induces players to continue a particular game.

BRIEF DESCRIPTION OF THE DRAWINGS

FIG. 5 is an explanatory diagram illustrating symbol arrays of video reels in the slot game.

FIG. 6 is an explanatory diagram of a symbol combination table regarding the slot game.

DETAILED DESCRIPTION OF THE INVENTION

Embodiment

An information processor of the present invention will be described with reference to figures.

A game executed in the present embodiment is, as application software (a program and game data), installed in and executed by an information processor. Examples of the information processor include mobile information devices such as a smartphone, a portable computer, a laptop computer, a note PC, a tablet PC, a handheld PC, and a PDA (Personal Data Assistant). The application software by which the game is executed is downloaded from an unillustrated server or the like via communication means and stored in a storage device in the information processor. The communication means may be an interactive communication passage such as the Internet and a cable TV, or may be one-way broadcasting.

The application software by which the game is executed may be stored in a recording medium such as a CD-ROM, a DVD-ROM, an MO (optical magnetic disc), and a flash memory, and may be read from the recording medium and installed in the storage device of the information processor according to need.

Figure 1:
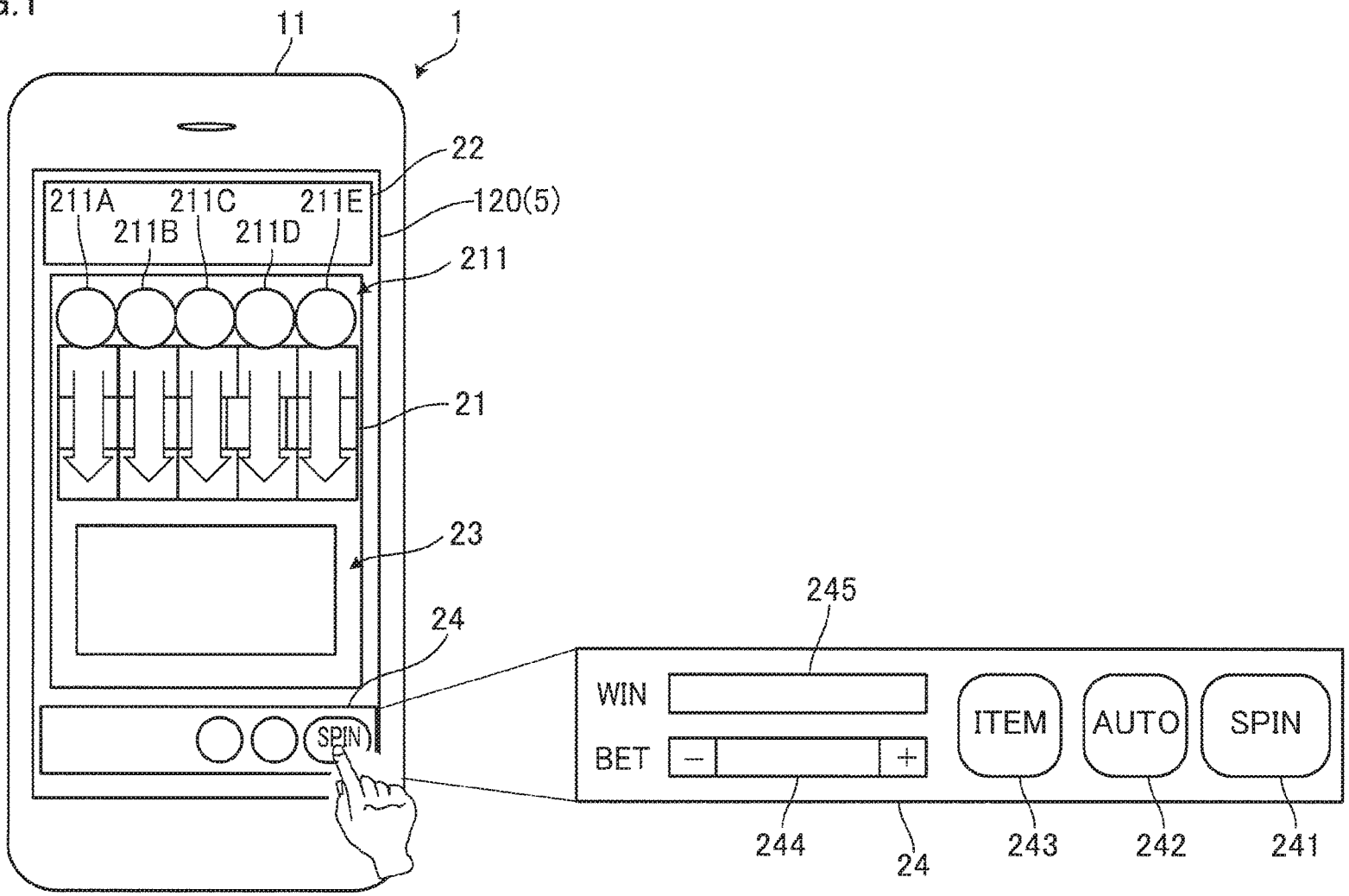
FIG. 1 illustrates image display on a smartphone (information processor).

In the present embodiment, a smartphone 1 shown in FIG. 1 is taken as an example of the information processor. While the descriptions below deal with the smartphone 1, processes and operations of the smartphone 1 can be interpreted as those of a program or a game control method.

(Structure of Smartphone 1)

Figure 2:
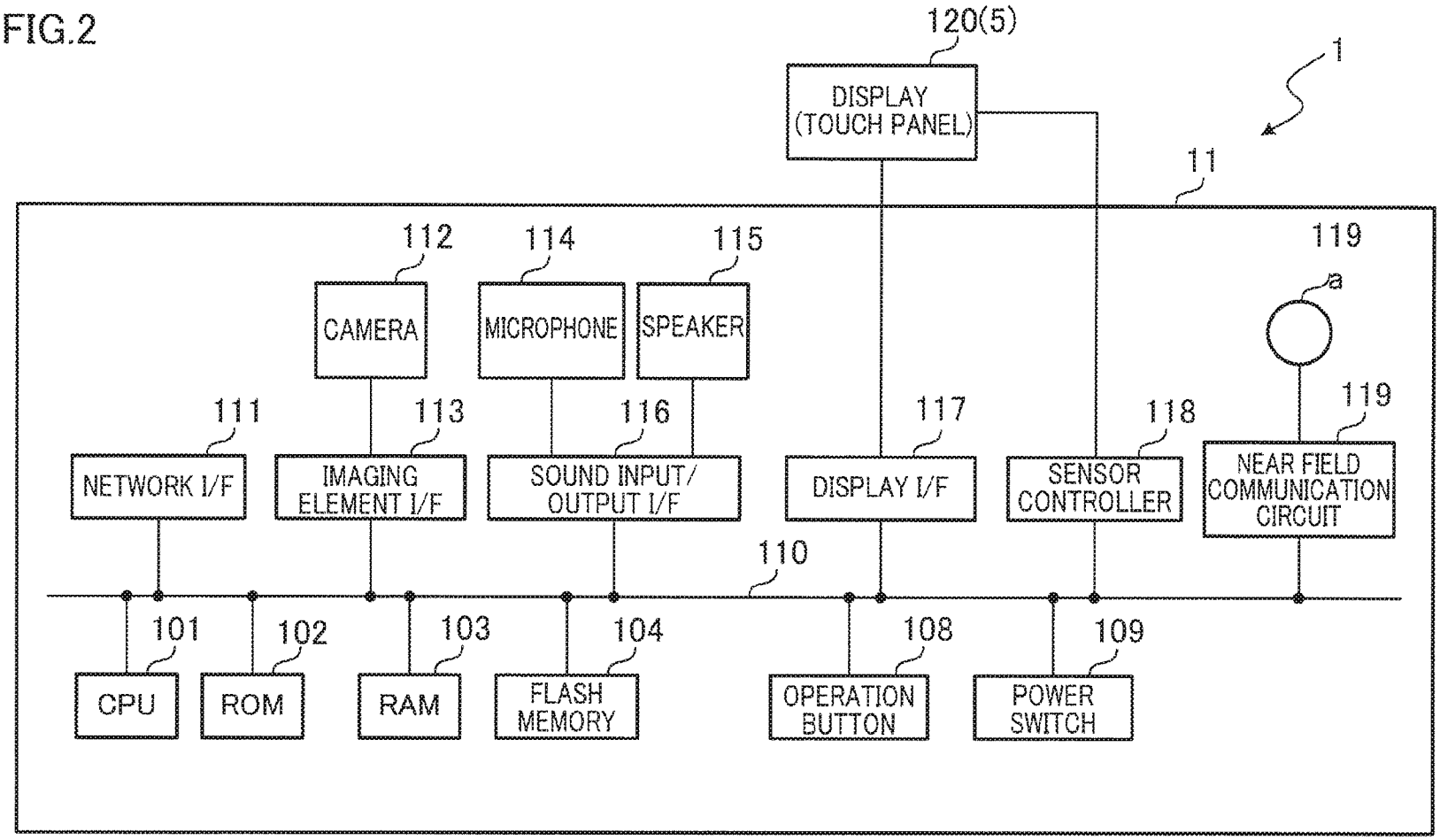
FIG. 2 is an electrical block diagram of the smartphone (information processor).

As shown in FIG. 2, the smartphone 1 includes, in a housing 11, a CPU 101, a ROM 102, a RAM 103, a flash memory 104, an operation button 108, a power switch 109, a bus line 110, a network I/F 111, a camera 112, an imaging element I/F 113, a microphone 114, a speaker 115, a sound input/output I/F 116, a display I/F 117, a sensor controller 118, a near field communication circuit 119, and an antenna 119*a* of the near field communication circuit 119. In the front surface of the housing 11, a display 120 with a touch panel 5 (input section) is embedded.

The display 120 is configured to be able to display images. The display method of the display 120 is, for example, liquid crystal, organic electroluminescence, CRT (Cathode Ray Tube), or plasma.

The CPU (Central Processing Unit) 101 controls the entire smartphone 1. The ROM (Read Only Memory) 102 stores programs used for driving the CPU 101, such as an IPL (Initial Program Loader).

The RAM (Random Access Memory) 103 is used as a work area of the CPU 101. The flash memory 104 stores application software (program) for executing the game of the present embodiment, a communication program, and sets of data such as image data and sound data (a later-described symbol array of a video reel and game data necessary for a slot game, such as a symbol combination table). The operation button 108 is used for, for example, initial setting of the smartphone 1. The power switch 109 is used for turning on/off the power source of the smartphone 1.

The network I/F (Interface) 111 is an interface for performing data communication by utilizing a communication network such as the Internet. The camera 112 is a built-in camera image capturing means which captures an image of an object to obtain image data under the control of the CPU 101. The imaging element I/F 113 is a circuit for controlling the camera 112. The microphone 114 is a built-in sound collection means to which sound is input. The sound input/output I/F 116 is a circuit for processing input and output of a sound signal between the microphone 114 and the speaker 115 under the control of the CPU 101. The display I/F 117 is a circuit for sending image data to the display 120 under the control of the CPU 101. The sensor controller 118 is a circuit for receiving an input from the touch panel 5 of the display 120. The near field communication circuit 119 is a communication circuit based on NFC (Near Field Communication) (Registered Trademark). Bluetooth (Registered Trademark), or the like. The bus line 110 is an address bus, a data bus, or the like for electrically connecting the components such as the CPU 101.

(Outline of Game Executed by Smartphone 1)

In the smartphone 1 structured as above, the CPU 101 is programmed to execute application software of the game.

In the smartphone 1, when application software of the game is executed, after a game start effect image or the like is displayed, a slot game starts upon selection of a selection image indicating the start of the slot game on the touch panel 5 (detailed later). For example, as shown in FIG. 1, when the slot game is selected, a slot game is executed so that symbols are rearranged in a symbol display area 21 which is formed of 15 areas forming a matrix with 5 columns and 3 rows (described later).

Plural types of slot games may be prepared for selection, and the rule, the state of payout, and effect images may be different depending on which slot game is executed. For example, in a slot game of one type, symbols are rearranged in a symbol display area formed of 9 areas forming a matrix with 3 columns and 3 rows. In this slot game, whether a win is achieved is determined based on a combination of symbols rearranged on a payline set only at the middle stage of the symbol display area (winning determination).

(Slot Game: Definition)

The game executed in the present embodiment is a slot game in which symbols are varied and stopped (rearranged) in the symbol display area 21 and a benefit (e.g., a payout or an item advantageous or disadvantageous for the player) is awarded based on the combination of the symbols displayed in the symbol display area 21 (see FIG. 1). A state in which symbols are displayed after being varied and stopped in the symbol display area 21 is termed "rearrangement". In the slot game, a bonus game advantageous for the player as compared to the normal game may be executed when the normal game is executed and a predetermined condition is satisfied in the normal game.

A benefit awarded in response to a game result based on a combination of symbols displayed in the symbol display area 21 may be awarding of "gaming value". A coin, paper money, or electrically valuable information corresponding to these is used as the gaming value. Note that the gaming value in the present invention is not particularly limited. Examples of the gaming value include game media such as medals, tokens, cyber money, and tickets, when the slot game of the present embodiment is executed by a gaming machine (slot machine) installed in a hall or the like. A ticket is not particularly limited, and a barcoded ticket may be adopted for example. Alternatively, the gaming value may be a game point not including valuable information.

The "unit game" is a series of operations from the start of the receiving of a bet to a state in which an award can be established. To put it differently, the unit game includes a single bet time for receiving a bet, a single game time of rearranging stopped symbols, and a single payout time of a payout process of awarding a payout.

(Slot Game Screen)

Now, a slot game screen displayed on the display 120 will be described.

As shown in FIG. 1, when the slot game is executed, the slot game screen is displayed on the display 120. The slot game screen displays the symbol display area 21 formed of 15 areas forming a matrix with 5 columns and 3 rows, a capsule display area 211, a game information display area 22 on which information of increment in accordance with the execution of the slot game (e.g., the number of times of execution of the current game) is displayed, an effect display area 23 on which moving and still images of game characters or the like and messages are displayed in accordance with the progress of the slot game, and an operation display area 24 which is operated by the player to progress the slot game. The operation display area 24 includes a spin button 241, an AUTO button 242, an ITEM button 243, a bet button 244, and a WIN display portion 245.

On the entire surface of the display 120, a touch panel 5 which allows the slot game screen to be viewable from the outside is provided. The touch panel 5 makes it possible to detect the coordinates of a part touched by a player's finger or the like. With this arrangement, for example, the slot game (unit game) is executed once, as the image of the spin button 241 is pressed. Furthermore, the slot game is serially executed plural times as the image of the AUTO button 242 is pressed. When the image of the ITEM button 243 is pressed, the player is able to select and use a previouslyobtained item (which exerts an influence advantageous or disadvantageous for the player in the slot game).

(Symbol Display Area 21)

Figure 3:
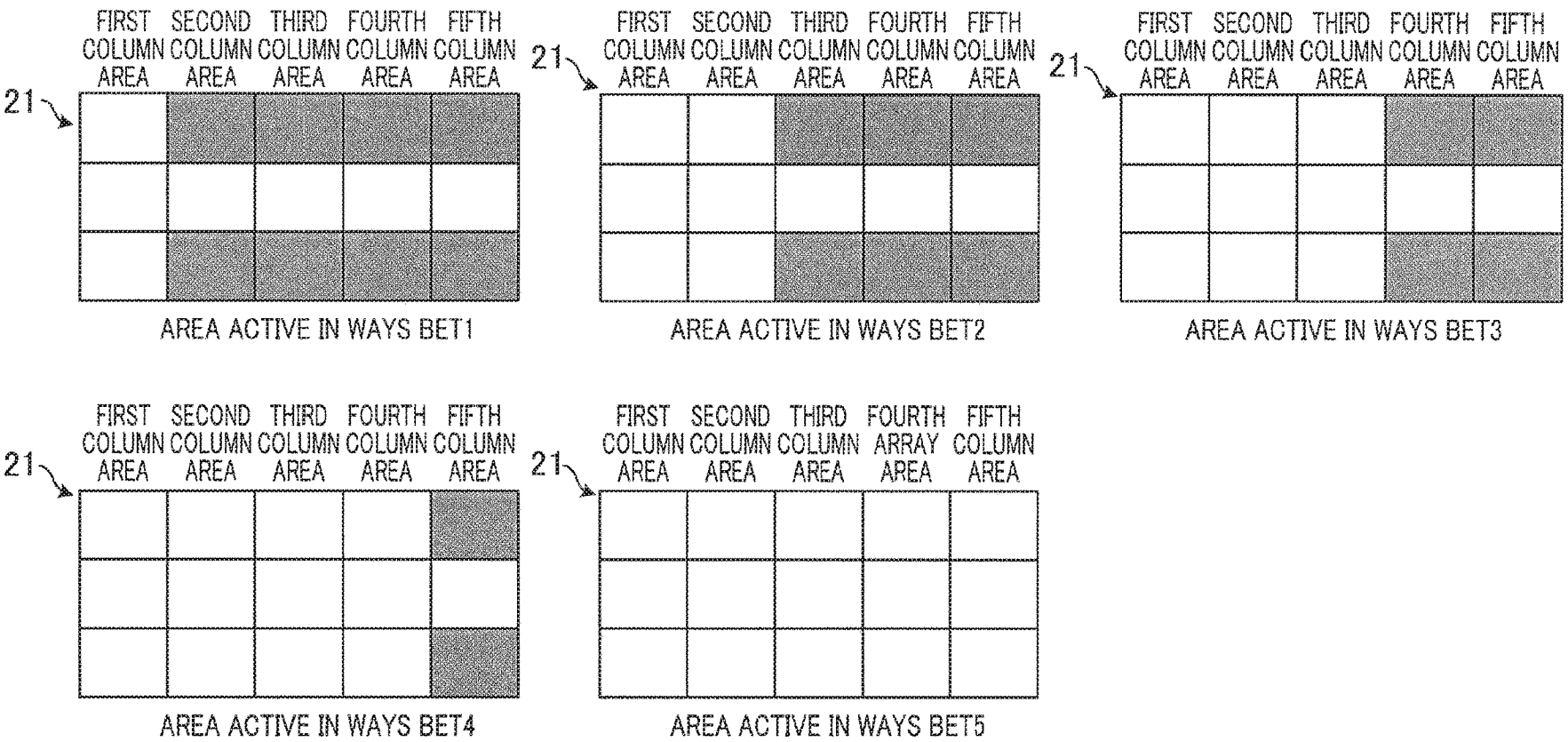
FIG. 3 illustrates active areas of "WAYS BET" in a slot game.
Figure 4:
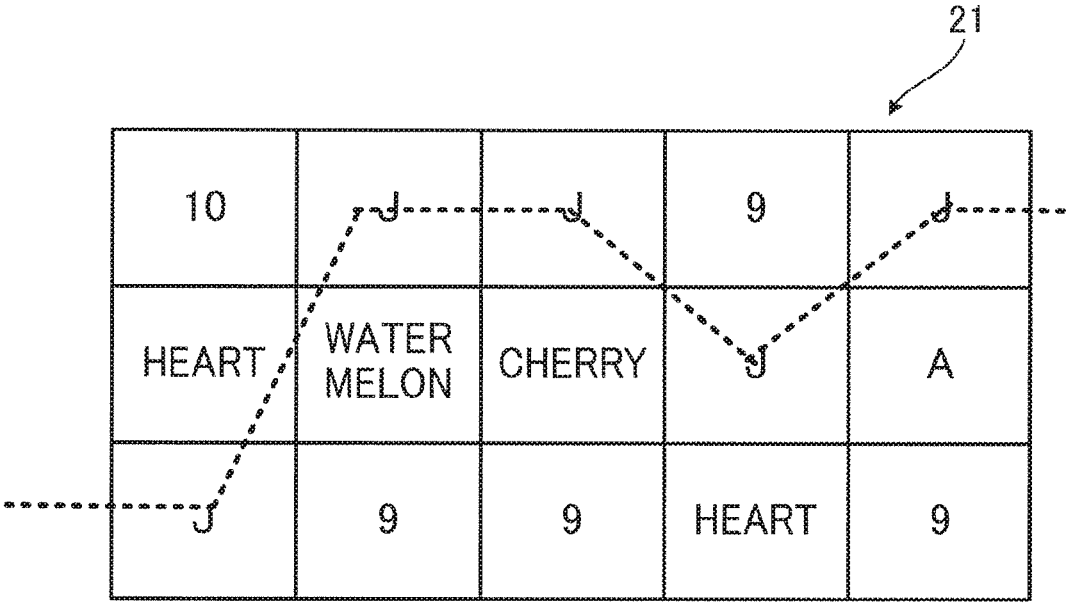
FIG. 4 is an explanatory diagram of an example of winning determination regarding "WAYS BET" in the slot game.

As described above, the symbol display area 21 of the slot game includes 5 column areas (first column area to fifth column area) each of which is divided into three areas: the upper stage, the middle stage, and the lower stage, as shown in FIG. 3 and FIG. 4. In the first column area to fifth column area, five video reels 3 (REEL1, REEL2, REEL3, REEL4, and REEL5) are displayed, respectively. In the slot game of the present embodiment, the video reels 3 are for expressing in the form of a video rotation and stop of symbols depicted on the circumferential surfaces of mechanical reels. To each of the video reels 3 (REEL1, REEL2, REEL3, REEL4, and REEL5), a symbol array formed of symbols is allocated (FIG. 5).

In the symbol display area 21, the symbol array allocated to each video reel 3 (REEL1, REEL2, REEL3, REEL4, and REEL5) scrolls, and stops after elapse of a predetermined time. As a result, parts of the respective symbol arrays (three successive symbols) are serially displayed in the symbol display area 21. In each of the first column area to the fifth column area of the symbol display area 21, one symbol is displayed in each of the three areas of the column area, i.e., the upper stage, the middle stage, and the lower stage, according to the corresponding video reel 3 (REEL1, REEL2, REEL3, REEL4, and REEL5). To put it differently, 15 symbols forming a matrix with 5 columns and 3 rows are displayed in the symbol display area 21.

As described above, in the symbol display area 21, 15 areas are provided to form a matrix in such a way that 5 column areas (columns) intersect three stages (stages) which are the upper stage, the middle stage, and the lower stage.

The slot game adopts a so-called "LEFT TO RIGHT" type for determination of a winning. That is, by selecting one of five stages of WAYS BET (WAYS BET1, WAYS BET2, WAYS BET3, WAYS BET4, and WAYS BET5), there are determined winning determination areas to be subjected to winning determination, out of 15 areas (the 5 by 3 matrix) of the symbol display area 21 (determination of active areas). Then a win occurs when a predetermined number of symbols stopped in the winning determination areas of the first column area to fifth column area, which areas are subjected to winning determination, are linked (see FIG. 4).

The selection of one of the five stages of WAYS BET (WAYS BET1, WAYS BET2, WAYS BET3, WAYS BET4, and WAYS BET5) is done by pressing a "+" button or a "−" button on the bet button 244 (see FIG. 1). 1 credit is required to select the WAYS BET1. 3 credits are required to select the WAYS BET2. 7 credits are required to select the WAYS BET3. 15 credits are required to select the WAYS BET4. 25 credits are required to select the WAYS BET5.

Specifically, as shown in FIG. 3, when "WAYS BET1" is selected, the areas out of the symbol display area 21 subjected to winning determination (areas activated) are: the upper stage, the middle stage, and the lower stage of the first column area; the middle stage of the second column area; the middle stage of the third column area; the middle stage of the fourth column area; and the middle stage of the fifth column area. Further, when "WAYS BET2" is selected, the areas out of the symbol display area 21 subjected to winning determination (areas activated) are: the upper stage, the middle stage, and the lower stage of the first column area; the upper stage, the middle stage, and the lower stage of the second column area; the middle stage of the third column area; the middle stage of the fourth column area; and the middle stage of the fifth column area. Further, when "WAYS BET3" is selected, the areas out of the symbol display area 21 subjected to result determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. Further, when "WAYS BET4" is selected, the areas out of the symbol display area 21 subjected to winning determination (areas activated) are: the upper stage, the middle stage, and the lower stage of the first column area; the upper stage, the middle stage, and the lower stage of the second column area; the upper stage, the middle stage, and the lower stage of the third column area; the upper stage, the middle stage, and the lower stage of the fourth column area; and the middle stage of the fifth column area. Further, when "WAYS BET5" is selected, the areas out of the symbol display area 21 subjected to winning determination (areas activated) are: the upper stage, the middle stage, and the lower stage of the first column area; the upper stage, the middle stage, and the lower stage of the second column area; the upper stage, the middle stage, and the lower stage of the third column area; the upper stage, the middle stage, and the lower stage of the fourth column area; and the upper stage, the middle stage, and the lower stage of the fifth column area.

For example, as shown in FIG. 4, when the "WAYS BET5" is selected, all the areas out of the symbol display area 21 are subjected to winning determination (activated). As shown in FIG. 4, when "J: Jack" symbols stop in the lower stage of the first column area, the upper stage of the second column area, the upper stage of the third column area, the middle stage of the fourth column area, and the upper stage of the fifth column area, there is a single win in which the "J: Jack" symbols are linked from the first column area to the fifth column area (LEFT TO RIGHT). In the "LEFT TO RIGHT" type, the symbols may appear to be scattered at the first sight; however, if they are continuously linked throughout the first column area to the fifth column area, it is determined as a win. Although the slot game of the present embodiment adopts the "LEFT TO RIGHT" type, it is possible to adopt a line type which regards, as a winning line, a line connecting the middle stages of the column areas of columns. Alternatively, a scatter type may be adopted so that whether a win is achieved is determined in accordance with the number of symbols of the same type displayed on the symbol display area 21.

(Capsule Display Area 211)

As shown in FIG. 1, in the capsule display area 211, 5 capsules 211A to 211E are displayed above the symbol display area 21. In other words, 5 capsules 211A to 211E are displayed outside the symbol display area 21. The 5 capsules 211A to 211E correspond to parts above the first column area to the fifth column area, respectively. In each of the 5 capsules, a symbol (one of "7", "HEART", "BELL", "WATERMELON", "CHERRY", "ACE", "KING", "QUEEN", "JACK", "TEN", "NINE", and "WILD") determined in a later-described capsule symbol random determination process is displayed (see FIG. 9). The symbol displayed in each of the capsules 211A to 211E is displayed outside the symbol display area 21 and therefore is not involved with winning determination.

(Symbol Arrays of Video Reels)

Now, with reference to FIG. 5, the following describes a configuration of the symbol arrays on the video reels 3 of the slot game (equivalent to a symbol random determination table).

As shown in FIG. 5, to each of "Reel1", "Reel2", "Reel3", "Reel4", and "Reel5" of the video reels 3, a symbol array formed of symbols corresponding to code numbers 0 to 33 is allocated. The types of the symbols in each symbol array of the video reel 3 include normal symbols "7", "HEART", "BELL", "WATERMELON", "CHERRY", "ACE", "KING", "QUEEN", "JACK", "TEN", and "NINE" and a "WILD" symbol which is a symbol capable of functioning as any symbols (i.e., an almighty symbol).

(Symbol Combination Table)

Now, the symbol combination table will be described with reference to FIG. 6. FIG. 6 is an explanatory diagram of the symbol combination table in the slot game of the present embodiment.

The symbol combination table of the slot game defines the combinations of symbols (the number of symbols) with which a win (WIN) is achieved and payout amounts (payouts). In the slot game, a win is achieved when the scroll of the symbol array of each video reel 3 is stopped and a predetermined number of symbols of a predetermined type displayed in the symbol display area 21 form a line which goes through the first column area to the fifth column area within the winning determination area set to be the subject of the winning determination by the WAYS BET described above. In accordance with the type of win, a benefit will be given to the player in the form of awarding a payout and the like.

Basically, a win is achieved when a predetermined number of symbols of a single type are arranged and linked to one another, as in three-symbols (3Kind), four-symbols (4Kind), or five-symbols (5Kind) combination, through the first column area to the fifth column area, within the winning determination area set as the subject to winning determination, by the WAYS BET described above. The above symbols of the single type are "7", "HEART", "BELL", "WATERMELON", "CHERRY", "ACE", "KING", "QUEEN", "JACK", "TEN", and "NINE". The "WILD" substitutes the "7", "HEART", "BELL", "WATERMELON", "CHERRY", "ACE", "KING", "QUEEN", "JACK", "TEN", and "NINE" symbols.

For example, when "WAYS BET3" is selected, the areas out of the symbol display area 21 subjected to winning determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. When the scroll of the symbol arrays of the video reels 3 (REEL1, REEL2, REEL3, REEL4, and REEL5) is stopped and the "7" symbols stop at the lower stage of the first column area, the upper stage of the second column area, and the middle stage of the third column area, it is determined that a win is achieved with three linked "7" symbols from the first column area to the third column area ("LEFT TO RIGHT") (i.e., 3Kind of "7" is achieved). In this case, the symbol combination table shown in FIG. 6 is referred to, and a payout amount of "50" is determined. Based on the determined payout amount, a payout is awarded.

In the slot game, while a required bet amount (1 credit for WAYS BET1, 3 credits for WAYS BET2, 7 credits for WAYS BET3, 15 credits for WAYS BET4, and 25 credits for WAYS BET5) is determined for the first selection of the five stages of WAYS BET, the WAYS BET may be selected plural times in the unit game. For example, when the WAYS BET3 (7 credits) is selected three times, the required total bet amount is 21 credits (7×3), and a payout amount is 50×3=150 when 3Kind of "7" is achieved.

[Content of Program] Now, the program of the slot game executed by the smartphone 1 will be described with reference to FIG. 7 and FIG. 8.

(Main Control Process)

Figure 7:
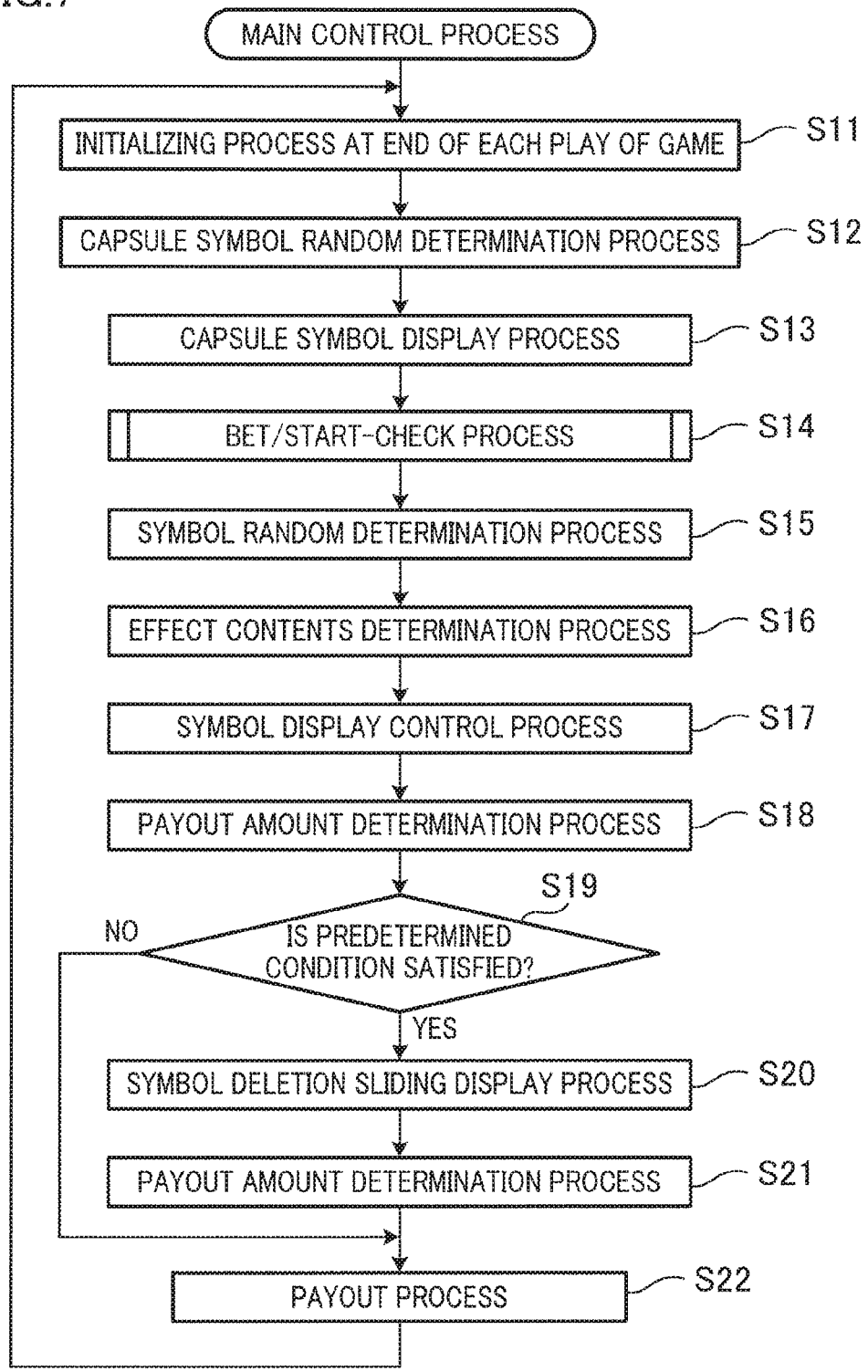
FIG. 7 is a flowchart of a main control process.
Figure 8:
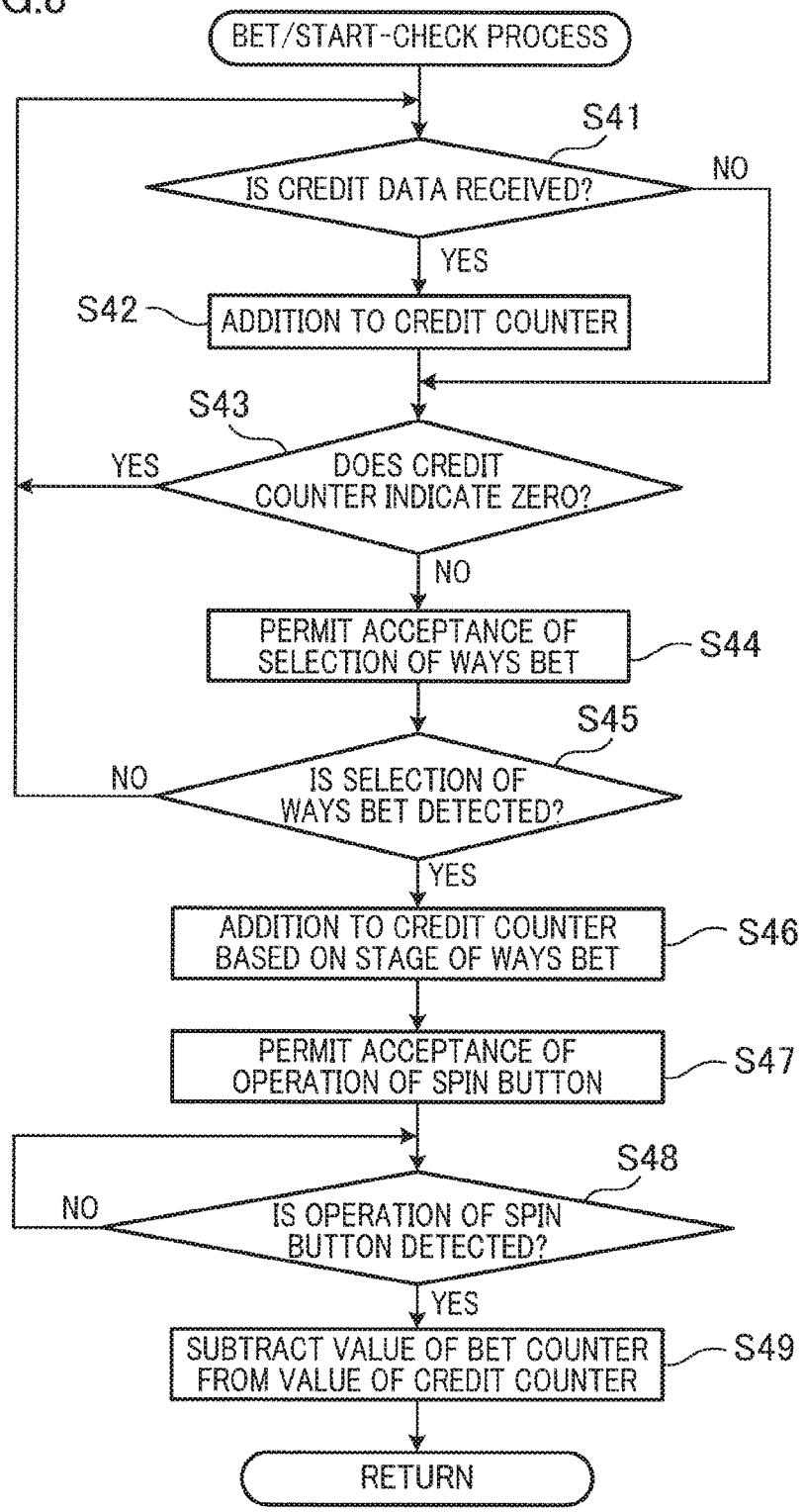
FIG. 8 is a flowchart of a bet/start check process.

Referring to FIG. 7, a main control process will be described.

To begin with, the main CPU 101 executes an initializing process at the end of each play of the game, in order to start the slot game (S11). For example, this process clears data in a working area of the flash memory 104, which becomes unnecessary at the end of each play of the unit game, e.g., WAYS BET activated in the previous execution of the unit game and symbols to be displayed on the symbol display area 21 as a result of random determination.

Subsequently, the CPU 101 executes a capsule symbol random determination process (equivalent to an out-of-area display symbol random determination process) (S12). In this capsule symbol random determination process, the symbol displayed in each of the 5 capsules 211A to 211E is randomly selected from the symbols ("7", "HEART", "BELL", "WATERMELON", "CHERRY", "ACE", "KING", "QUEEN", "JACK", "TEN", "NINE", and "WILD"). In this way, the 5 symbols displayed in the 5 capsules 211A to 211E are determined.

In the capsule symbol random determination process, symbols forming a combination with which a high payout is awarded may be selected by random number determination. For example, in the capsule symbol random determination process, only the symbols "7", "HEART", "BELL", "WATERMELON", and "CHERRY" (equivalent to second benefit symbols) are selected by random number determination and displayed in the 5 capsules 211A to 211E. In this case, the symbols "ACE", "KING", "QUEEN", "JACK", "TEN", and "NINE" (equivalent to first benefit symbols) are not displayed in the 5 capsules 211A to 211E. According to this arrangement, because the symbols displayed on the capsules 211A to 211E are advantageous for a high payout, the player is induced to play the slot game.

Figure 9:
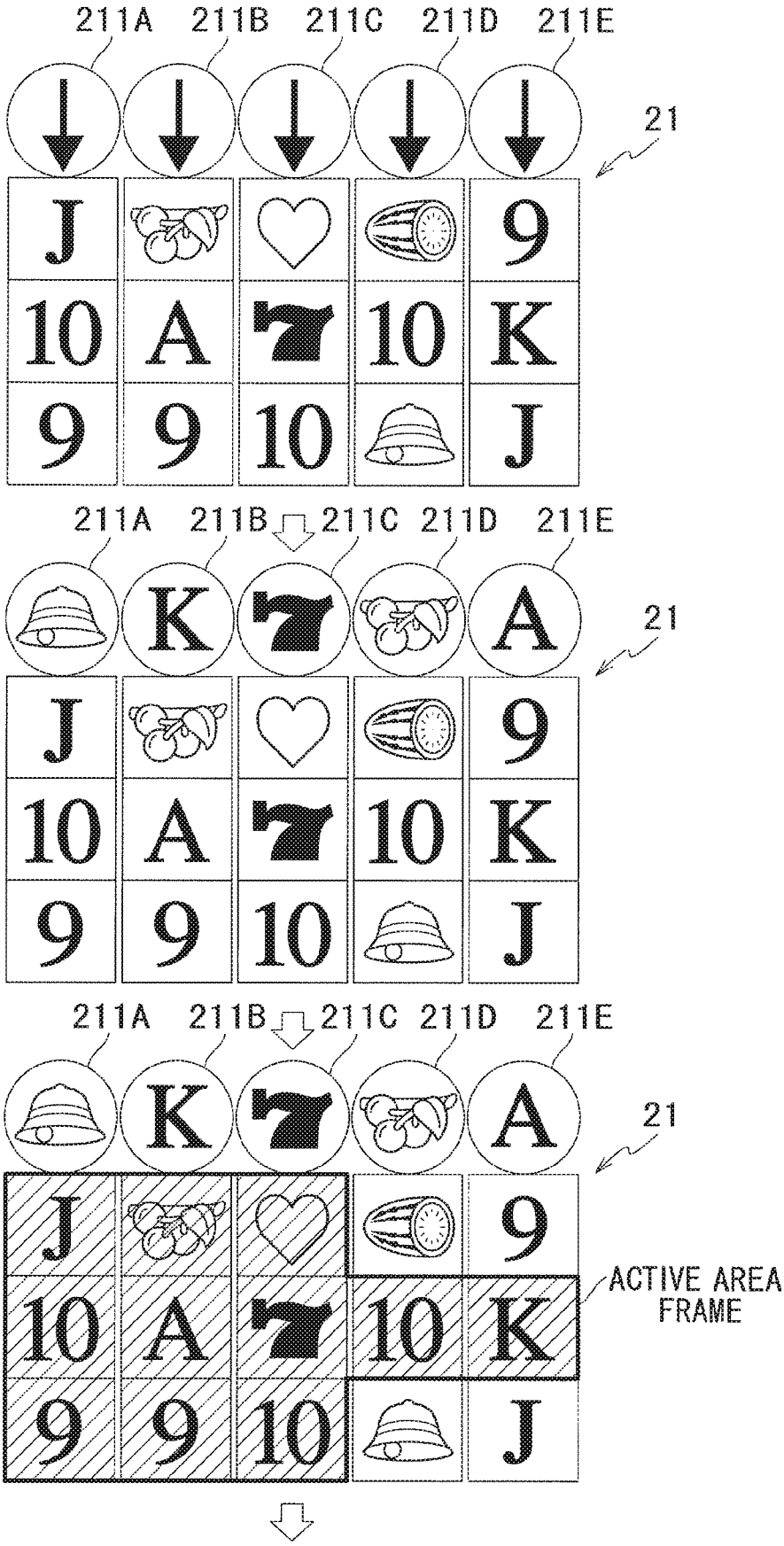
FIG. 9 shows a game content displayed on a display.

Subsequently, the CPU 101 executes a capsule symbol display process (S13). In this capsule symbol display process, as shown in FIG. 9, to begin with, an effect is displayed such that the symbols ("7", "HEART", "BELL", "WATERMELON", "CHERRY", "ACE", "KING", "QUEEN", "JACK", "TEN", "NINE", and "WILD") vertically scroll in the capsules 211A to 211E. Thereafter, the five symbols determined in the capsule symbol random determination process in S12 are displayed in the 5 capsules 211A to 211E. For example, when the symbols "BELL", "KING", "7", "CHERRY", and "ACE" are selected to be displayed in the 5 capsules 211A to 211E in the capsule symbol random determination process in S12, as shown in FIG. 9, the "BELL" symbol is displayed in the capsule 211A, the "KING" symbol is displayed in the capsule 211B, the symbol "7" is displayed in the capsule 211C, the symbol "CHERRY" is displayed in the capsule 211D, and the symbol "ACE" is displayed in the capsule 211E.

The main CPU 101 then executes a later-described bet/start-check process (S14). In this process, input check or the like of the WAYS BET (WAYS BET1, WAYS BET2, WAYS BET3, WAYS BET4, or WAYS BET5) selected by the touch panel 5 or the like is performed. At this stage, as shown in FIG. 9, an active area frame is displayed in a flickering manner in an area of the symbol display area 21, which is selected as a target of winning determination as a result of the selection of the WAYS BET. This makes it possible to visually differentiate an area which is a target of winning determination from an area which is not a target of winning determination.

The main CPU 101 then executes a symbol random determination process (S15). In this symbol random determination process, by using the symbol arrays of the video reels 3 shown in FIG. 5, to-be-stopped symbols are randomly selected from the symbols on the symbol arrays (REEL1, REEL2, REEL3, REEL4, and REEL5) of the video reels 3. The to-be-stopped symbols are data of 5 symbols displayed in the middle stages of the first column area to the fifth column area of the symbol display area 21, among the symbols constituting the symbol arrays of the video reels 3. In this way, 15 symbols displayed in the symbol display area 21 are determined.

For example, in case of REEL1 of the video reel 3, when a code number "1" is randomly selected from 26 symbols (code numbers "0" to "25") forming the symbol array, the "CHERRY" symbol corresponding to the code number "1" is selected as the to-be-stopped symbol (see FIG. 5). In case of the REEL2, when a code number "2" is randomly selected from 29 symbols (code numbers "0" to "28") forming the symbol array, the "HEART" symbol corresponding to the code number "2" is selected as the to-be-stopped symbol. In case of the REEL3, when a code number "12" is randomly selected from 28 symbols (code numbers "0" to "27") forming the symbol array, the "KING" symbol corresponding to the code number "12" is selected as the to-be-stopped symbol. In case of the REEL4, when a code number "15" is randomly selected from 27 symbols (code numbers "0" to "26") forming the symbol array, the "7" symbol corresponding to the code number "15" is selected as the to-be-stopped symbol. In case of the REEL5, when a code number "1" is randomly selected from 34 symbols (code numbers "0" to "33") forming the symbol array, the "7" symbol corresponding to the code number "12" is selected as the to-be-stopped symbol.

The main CPU 101 stores the determined 5 to-be-stopped symbols in a symbol storing area in the flash memory 104.

The main CPU 101 then executes an effect contents determination process (S16). The main CPU 101 samples an effect-use random number and randomly determines any of a plurality of predetermined effect contents.

Then, the main CPU 101 executes a symbol display control process (S17). In this symbol display control process, scroll of the symbol arrays of the video reels 3 starts, and after a predetermined time elapses, 5 to-be-stopped symbols determined in the symbol random determination process in S13 are stopped one by one in the middle stages of the first column area to the fifth column area of the symbol display area 21. In other words, 15 symbols including the to-be-stopped symbols are rearranged in the symbol display area 21. For example, as described above, when the "CHERRY" symbol is selected as a to-be-stopped symbol in the REEL1, the "HEART" symbol is selected as a to-be-stopped symbol in the REEL2, the "KING" symbol is selected as a to-be-stopped symbol in the REEL3, the "7" symbol is selected as a to-be-stopped symbol in the REEL4, and the "7" symbol is selected as a to-be-stopped symbol in the REEL5, the symbols "CHERRY", "HEART", "KING", "7", and "7" are rearranged in the middle stages of the first column area to the fifth column area of the symbol display area 21. In the upper stages and the lower stages of the first column area to the fifth column area of the symbol display area 21, symbols having code numbers each of which is one number off the to-be-stopped symbols are rearranged (see FIG. 10).

The main CPU 101 then executes a payout amount determination process (S18). In this process, a symbol combination table for the slot game (see FIG. 6) stored in the flash memory 104 is referred to, to determine whether the symbols stopped in the symbol display area 21 include a predetermined number of symbols linked to one another through the first column area to the fifth column area in the WAYS BET set as the target of the winning determination, thus achieving a win. In accordance with the type of win, a benefit will be given in the form of awarding a payout and the like. The payout awarded is stored in a payout amount storage area of the flash memory 104.

Figure 10:
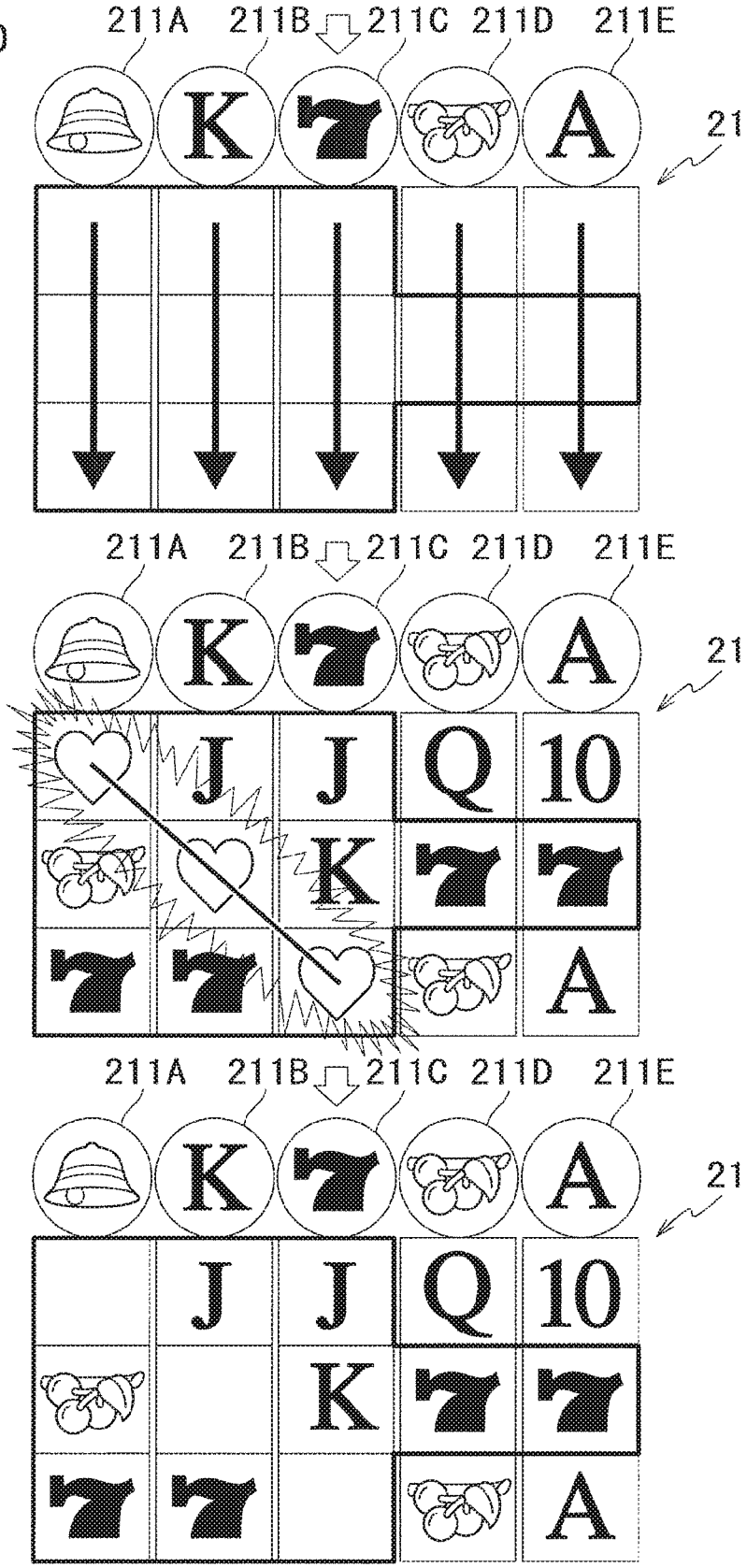
FIG. 10 shows a game content displayed on the display.

For example, as shown in FIG. 10, when "WAYS BET3" is selected, the areas out of the symbol display area 21 subjected to winning determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. As shown in FIG. 10, when "HEART" symbols stop in the upper stage of the first column area, the middle stage of the second column area, and the lower stage of the third column area, there is a single win in which three "HEART" symbols are linked from the first column area to the third column area (LEFT TO RIGHT). To visually indicate that 3Kind of "HEART" is achieved, the three "HEART" symbols emit light and then flicker, as shown in FIG. 10. For the 3Kind of "HEART", a symbol combination table shown in FIG. 6 is referred to, and a payout is determined as "35" credits and this payout amount is stored in the payout amount storage area in the flash memory 104.

The CPU 101 then determines if a predetermined condition is satisfied (S19). The predetermined condition in the present embodiment is establishment of a win. That is to say, the predetermined condition is satisfied when a predetermined number of symbols of a predetermined type are linked from the first column area to the fifth column area in an area which is selected as a target of winning determination by the WAYS BET above and a win is achieved (see FIG. 6). On this account, the predetermined condition is satisfied when 3Kind of "HEART" is established as shown in FIG. 10.

When the predetermined condition is satisfied (YES in S19), the CPU 101 executes a symbol deletion sliding display process (S20). In the symbol deletion sliding display process, to begin with, an effect is displayed such that the symbols forming the win are deleted from the symbol display area 21. Subsequently, in the column area of the deleted symbol, all symbols rearranged above the deleted symbol and the symbol displayed in one of the capsules 211A to 211E which corresponds to the column area of the deleted symbol are scrolled (slid) downward together. As a result, a symbol is arranged again in the area corresponding to the deleted symbol. In this regard, the symbol displayed in one of the capsules 211A to 211E which corresponds to the column area of the deleted symbol (i.e., the symbol displayed outside the symbol display area 21) becomes displayed in the symbol display area 21.

Figure 11:
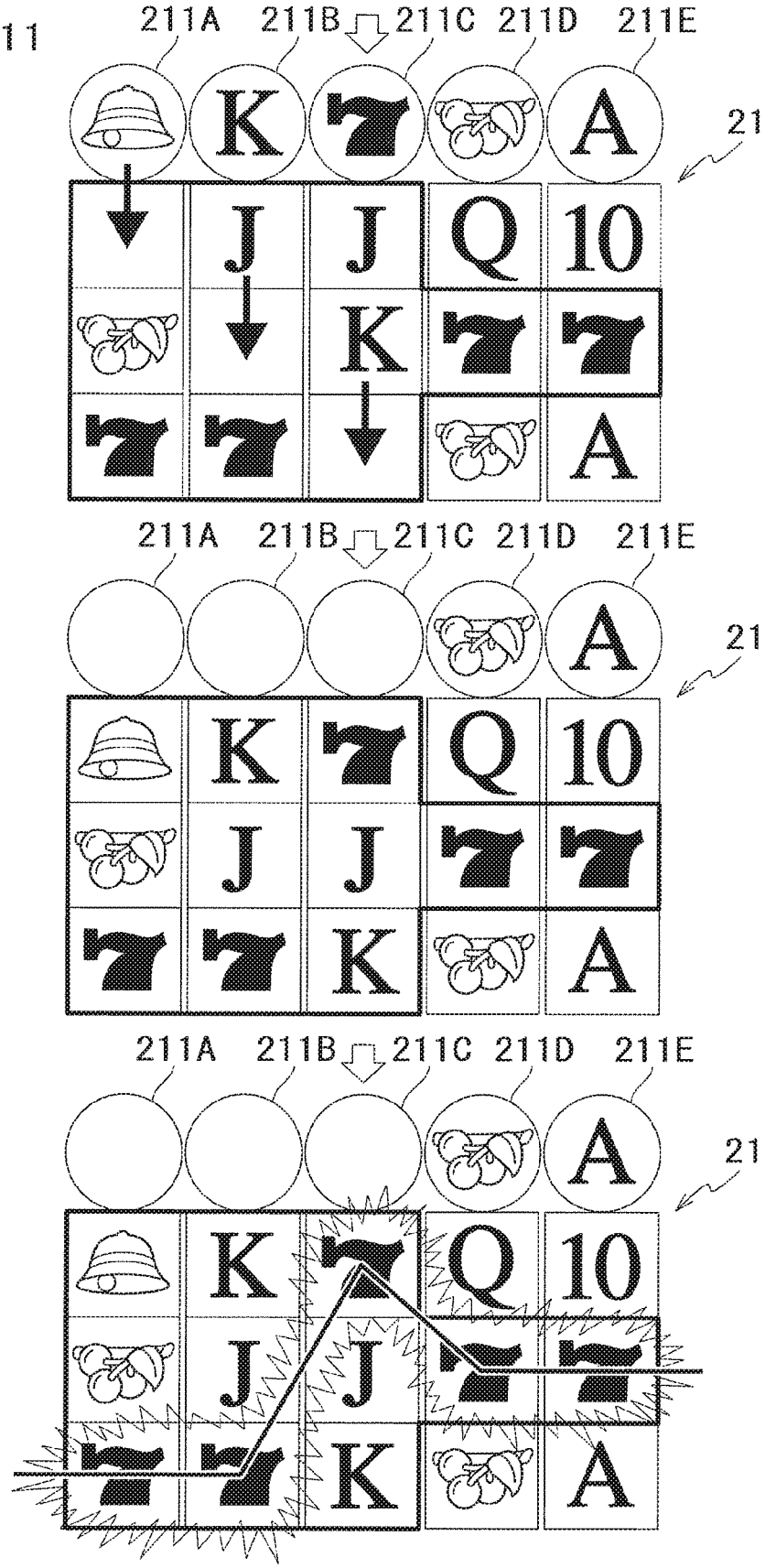
FIG. 11 shows a game content displayed on the display.

For example, as shown in FIG. 10, when 3Kind of "HEART" is achieved, an effect is displayed such that, in the symbol display area 21, the three "HEART" symbols stopped in the upper stage of the first column area, the middle stage of the second column area, and the lower stage of the third column area disappear. Thereafter, as shown in FIG. 11, in the first column area of the symbol display area 21, the "BELL" symbol displayed in the capsule 211A is scrolled downward and arranged in the upper stage of the first column area. In the second column area of the symbol display area 21, the "JACK" symbol arranged in the upper stage of the second column area and the "KING" symbol displayed in the capsule 211B are scrolled downward together and arranged in the middle stage and the upper stage of the second column area, respectively. In the third column area of the symbol display area 21, the "KING" symbol arranged in the middle stage of the third column area, the "JACK" symbol displayed in the upper stage of the third column area, and the "7" symbol displayed in the capsule 211C are scrolled downward together and arranged in the lower stage, the middle stage, and the upper stage of the third column area, respectively.

The main CPU 101 then executes the payout amount determination process again (S21). In this process, the symbol combination table for the slot game (see FIG. 6) stored in the flash memory 104 is referred to, to determine whether the symbols stopped in the symbol display area 21 after the symbol deletion sliding display process include a predetermined number of symbols linked to one another through the first column area to the fifth column area in the WAYS BET set as the target of the winning determination, thus achieving a win. In accordance with the type of win, a benefit will be given in the form of awarding a payout and the like. The payout awarded is stored in a payout amount storage area of the flash memory 104.

For example, as shown in FIG. 11, when "WAYS BET3" is selected, the areas out of the symbol display area 21 subjected to winning determination (areas activated) are: the upper stage, the middle stage, and the lower stage of the first column area; the upper stage, the middle stage, and the lower stage of the second column area; the upper stage, the middle stage, and the lower stage of the third column area; the middle stage of the fourth column area; and the middle stage of the fifth column area. As shown in FIG. 11, because in the symbol display area 21 after the symbol deletion sliding display process the "7" symbols are provided in the lower stage of the first column area, the lower stage of the second column area, the upper stage of the third column area, the middle stage of the fourth column area, and the middle stage of the fifth column area, one win is achieved by 5 linked "7" symbols from the first column area to the fifth column area (LEFT TO RIGHT). To visually indicate that 5Kind of "7" is achieved, the 5 "7" symbols emit light and then flicker, as shown in FIG. 11. For the 5Kind of "7", a symbol combination table shown in FIG. 6 is referred to, and a payout is determined as "1000" credits and this payout amount is stored in the payout amount storage area in the flash memory 104.

After S21, if in S19 the predetermined condition is not satisfied (NO in S19), a payout process is executed (S22). The CPU 101 adds a value stored in the payout amount storage area to a value stored in a credit counter provided in the flash memory 104. For example, when "35" credits are awarded in the payout amount determination process in S18 and "1000" credits are awarded in the payout amount determination process in S21, "1035" credits are added to the value of the credit counter.

After S22, the routine proceeds to S11.

When the predetermined condition is not satisfied in S19 (NO in S19), the routine goes back to S11 and the symbols displayed in the capsules 211A to 211E are cleared in the initializing process at the end of each play of the game. Alternatively, when the predetermined condition is not satisfied in S19, the routine goes back to S11 but the symbols displayed in the capsules 211A to 211E may not be cleared and may be used in the next unit game.

In this case, the capsule symbol random determination process in S12 and the capsule symbol display process in S13 are skipped.

As such, when the predetermined condition is not satisfied in S19, the next unit game is executed while the symbols are kept displayed in the capsules 211A to 211E. According to this arrangement, when the symbols displayed in the capsules 211A to 211E are symbols advantageous for the awarding of a benefit (i.e., symbols constituting a symbol combination with which a high payout is awarded), the player is induced to play the next unit game.

(Bet/Start-Check Process)

Now the bet/start-check process will be described with reference to FIG. 8.

To begin with, the CPU 101 determines whether credit data which is equivalent to in-game currency has been received (S41).

When the credit data has been received (YES in S41), the CPU 101 adds the amount indicated by the received credit data to the value of the credit counter in the flash memory 104 (S42).

After the step S42 or when determining in S41 that no credit data is received (NO in S41), the main CPU 101 determines whether or not the value stored in the credit counter is 0 (S43). When determining that the value of the credit counter is 0 (YES in S43), the main CPU 101 goes back to S41.

When the main CPU 101 determines that the value of the credit counter is not 0 (NO in S43), the main CPU 101 permits acceptance of selection of one of the 5 stages of WAYS BET (WAYS BET1, WAYS BET2, WAYS BET3, WAYS BET4, and WAYS BET5) input by pressing the "+" or "−" button of the bet button 244 (see FIG. 1) of the touch panel 5 (S44). By selecting any of the 5 stages of WAYS BET, a winning determination area to be subjected to winning determination is selected out of 15 areas of the 5 by 3 matrix of the symbol display area 21 (see FIG. 3).

Subsequently, the CPU 101 determines whether the selection operation (pressing) of any of the 5 stages of WAYS BET (WAYS BET1, WAYS BET2, WAYS BET3, WAYS BET4, and WAYS BET5) has been detected (S45). When the selection operation of the WAYS BET has not been detected (NO in S45), the routine proceeds to S41.

In the meanwhile, when the selection of one of the 5 stages of WAYS BET (WAYS BET1, WAYS BET2, WAYS BET3, WAYS BET4, and WAYS BET5) is detected (YES in S45), the CPU 101 adds, to the value of the bet counter in the flash memory 104, a credit necessary for the WAYS BET (1 credit in case of WAYS BET1, 3 credits in case of WAYS BET2, 7 credits in case of WAYS BET3, 15 credits in case of WAYS BET4, or 25 credits in case of WAYS BET5) (S46).

Subsequently, after S46, the main CPU 101 allows the spin button 241 to accept an operation (S47).

After S47, the main CPU 101 determines whether or not an operation of the spin button 241 is detected (S48). When the main CPU 101 determines that an operation of the spin button 241 is not detected (NO in S48), an operation of the spin button 241 is waited for.

In the meanwhile, when the main CPU 101 determines that an operation of the spin button 241 is detected (YES in S48), the main CPU 101 subtracts the value of the bet counter calculated in S46 from the value of the credit counter (S49). Then the bet/start check process is terminated.

As in the embodiment above, when a combination of symbols determined in the symbol random determination process is displayed in the symbol display area 21 and satisfies a predetermined condition (winning) in S19, a symbol selected from symbols displayed in the capsules 211A to 211E is displayed in the symbol display area 21. In other words, when the predetermined condition is satisfied, a symbol displayed in the capsules 211A to 211E is added to the symbol display area 21 based on which whether to award a payout in accordance with a combination of symbols is determined. As a result, the unit game is executed while a symbol which may be added to the symbol display area 21 based on which whether to award a payout is determined is displayed in the capsules 211A to 211E. When the predetermined condition is satisfied, symbols including a symbol displayed in the capsules 211A to 211E are displayed in the symbol display area 21, and a payout is awarded again based on this symbol display area 21. This makes it possible to avoid monotony in the game play.

Modification 1

In the present embodiment, the main control process shifts to the payout process in S22 after the symbol deletion sliding display process in S20. Alternatively, as shown in a flowchart of a main control process of Modification 1 in FIG. 12, the main control process may shift to S19 after the symbol deletion sliding display process in S20.

Figure 12:
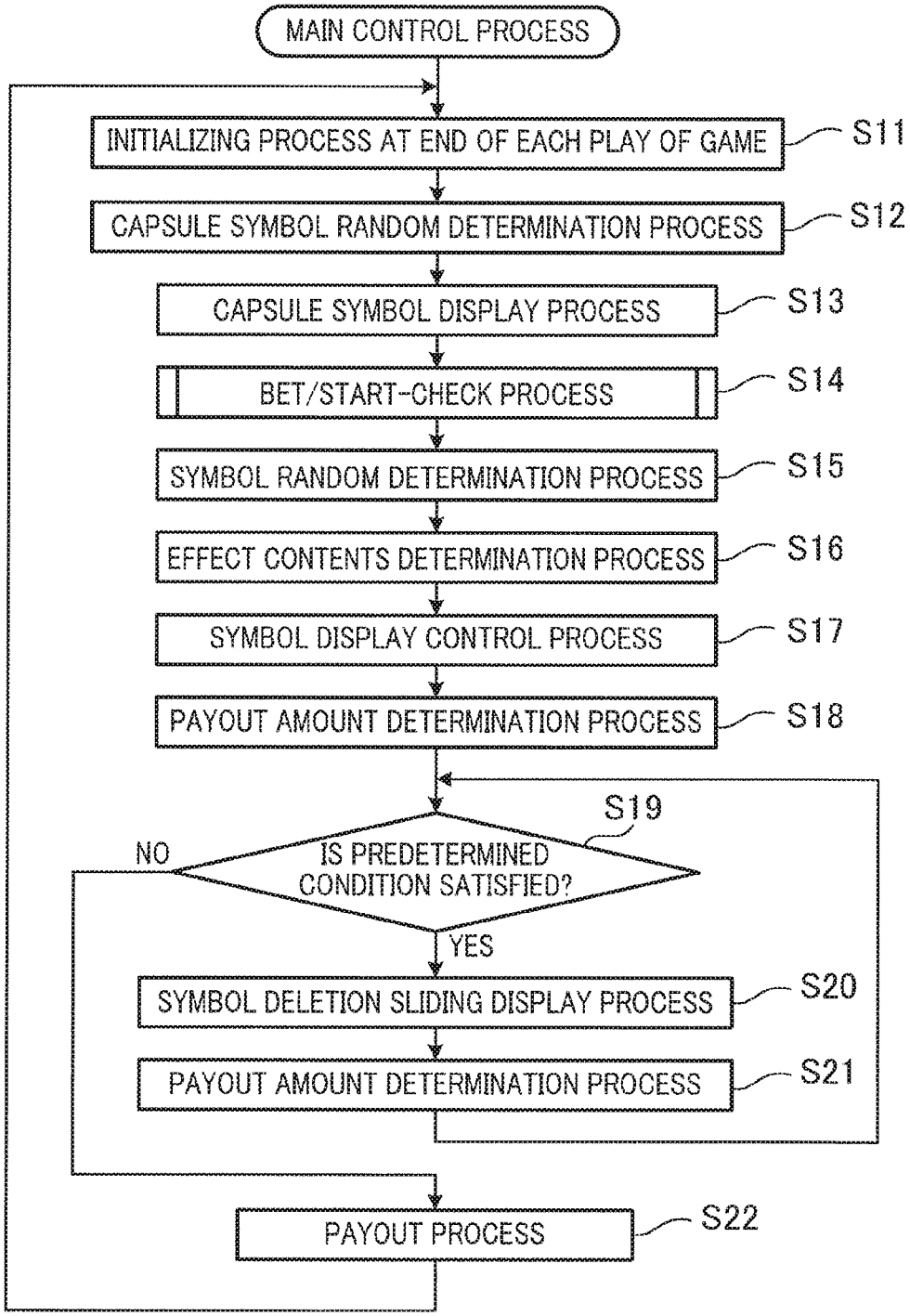
FIG. 12 is a flowchart of a main control process of Modification 1.

In this case, as shown in FIG. 12, capsules 211F to 211J are displayed behind the 5 capsules 211A to 211E, respectively. Displayed in these capsules 211F to 211J are symbols which are to be moved to the capsules 211A to 211E which are blank after the symbols displayed in the capsules 211A to 211E are moved to the symbol display area 21 in the above-described symbol deletion sliding display process in S20. The symbols displayed in these capsules 211F to 211J are determined by random number determination in the same manner as in the capsule symbol random determination process in S12 above.

Based on this disclosure of Modification 1, the main control process will be described with reference to the flowchart of Modification 1 shown in FIG. 12. Because S11 to S21 are identical with those in the embodiment above, the description starts from a step after S21.

After S21, the process goes back to S19 and whether a winning is established is determined again. For example, as shown in FIG. 11 and FIG. 13, because in the symbol display area 21 after the symbol deletion sliding display process the "7" symbols are provided in the lower stage of the first column area, the lower stage of the second column area, the upper stage of the third column area, the middle stage of the fourth column area, and the middle stage of the fifth column area in the symbol deletion sliding display process (S20) before the return to S19, one win is achieved by 5 linked "7" symbols from the first column area to the fifth column area (LEFT TO RIGHT) and hence the predetermined condition is satisfied (YES ion S19).

The CPU 101 then executes the symbol deletion sliding display process again (S20). For example, as shown in FIG. 13, when 5Kind of "7" is achieved, an effect is displayed such that, in the symbol display area 21, the 5 "7" symbols stopped in the lower stage of the first column area, the lower stage of the second column area, the upper stage of the third column area, the middle stage of the fourth column area, and the middle stage of the fifth column area disappear. Thereafter, as shown in FIG. 13, in the first column area of the symbol display area 21, the "CHERRY" symbol displayed in the middle stage of the first column area, the "BELL" symbol displayed in the upper stage of the first column area, and the "JACK" symbol displayed in the capsule 211A are scrolled downward together, and are displayed in the lower stage, the middle stage, and the upper stage of the first column area, respectively. In the second column area of the symbol display area 21, the "JACK" symbol displayed in the middle stage of the second column area, the "KING" symbol displayed in the upper stage of the second column area, and the "10" symbol displayed in the capsule 211B are scrolled downward together and arranged in the lower stage, the middle stage, and the upper stage of the second column area, respectively. In the third column area of the symbol display area 21, the "KING" symbol arranged in the capsule 211C is scrolled downward and arranged in the upper stage of the third column area. In the fourth column area of the symbol display area 21, the "QUEEN" symbol arranged in the upper stage of the fourth column area and the "CHERRY" symbol displayed in the capsule 211D are scrolled downward together and arranged in the middle stage and the upper stage of the fourth column area, respectively. In the fifth column area of the symbol display area 21, the "10" symbol arranged in the upper stage of the fifth column area and the "ACE" symbol displayed in the capsule 211E are scrolled downward together and arranged in the middle stage and the upper stage of the fifth column area, respectively.

Figure 13:
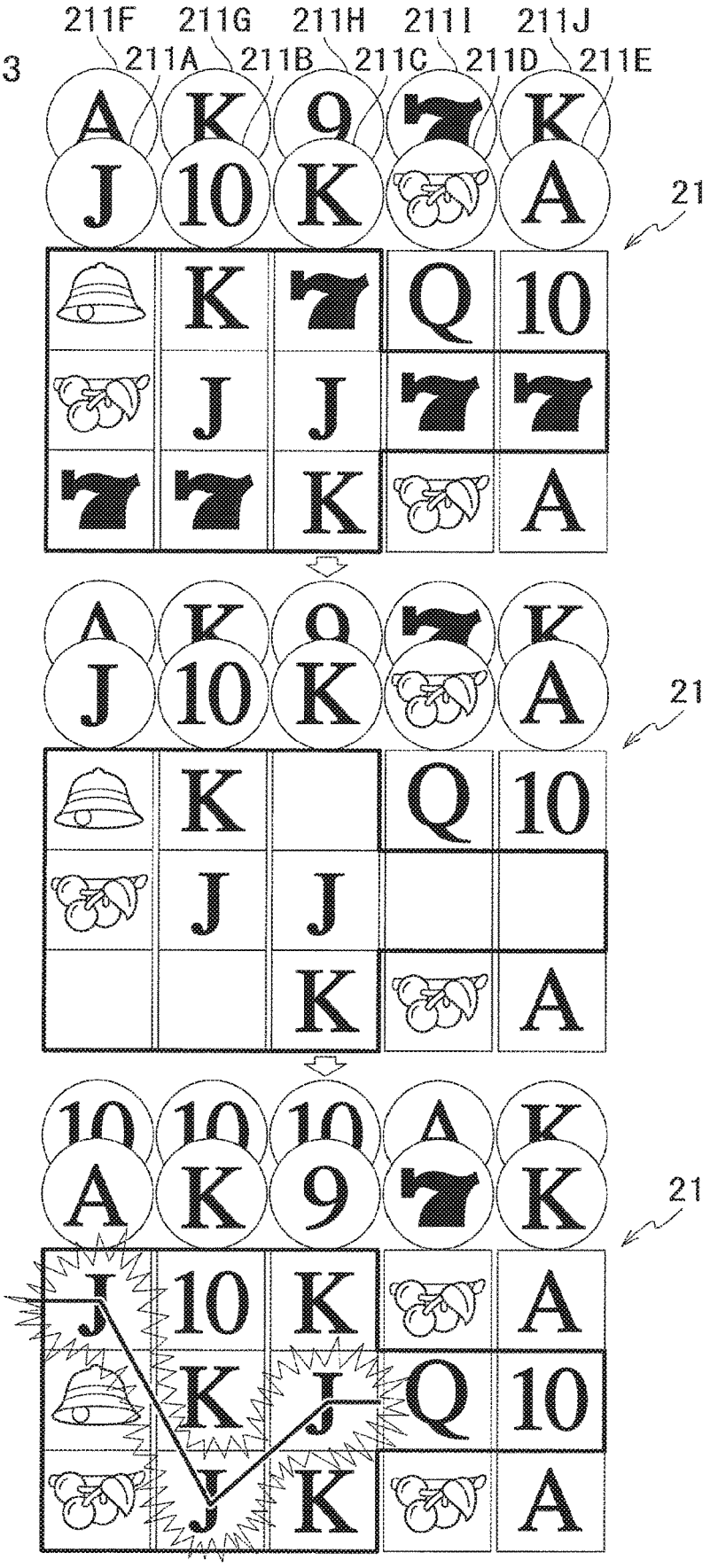
FIG. 13 shows a game content displayed on a display according to Modification 1.

To the capsules 211A to 211E which become blank in this symbol deletion sliding display process, the symbols displayed in the capsules 211F to 211J are moved (see FIG. 13). In the capsules 211F to 211J, symbol determined by random number determination are newly displayed (see FIG. 13).

The main CPU 101 then executes the payout amount determination process again (S21). For example, as shown in FIG. 13, when "WAYS BET3" is selected, because in the display area 21 after the symbol deletion sliding display process the "JACK" symbols are provided in the upper stage of the first column area, the lower stage of the second column area, and the middle stage of the third column area, one win is achieved by linked three "JACK" symbols from the first column area to the third column area (LEFT TO RIGHT). To visually indicate that 3Kind of "JACK" is achieved, the three "JACK" symbols emit light and then flicker. For the 3Kind of "JACK", a symbol combination table shown in FIG. 6 is referred to, and a payout is determined as "10" credits and this payout amount is stored in the payout amount storage area in the flash memory 104.

As described above, in the modification, the steps S19 to S21 are serially executed as long as wins are kept established. As a result, after a payout is awarded on account of a win and the symbols constituting the win disappear, symbols displayed in the capsules 211A to 211E are moved to the symbol display area 21 and based on which winning determination is performed, and a payout is awarded when a win is achieved again. This routine may be repeated.

After the serial execution of S19 to S21, if no win is achieved in S19 (NO in S19), the process shifts to the payout process in S22.

Modification 2

In the embodiment above, the predetermined condition in S19 is establishment of a win. The predetermined condition may be another deletion betting which is performed to delete a symbol (further insertion of a credit) and is different from the selection of WAY BET (or betting at this stage). (This is equivalent to a condition regarding a predetermined game.)

In this case, in the symbol display control process in S17, symbols, the number of which corresponds to the credit amount in the deletion betting, become selectable by the touch panel 5 for the player, out of 15 symbols rearranged in the symbol display area 21. For example, 1 symbol becomes selectable in response to 1 credit as the deletion betting, 2 symbols become selectable in response to 2 credits as the deletion betting, 2 symbols become selectable in response to 3 credits as the deletion betting, 4 symbols become selectable in response to 4 credits as the deletion betting, and 5 symbols become selectable in response to 5 credits as the deletion betting.

Thereafter, an effect is executed such that the symbols selected in the symbol display area 21 are deleted from the symbol display area 21. Subsequently, in the column area of the deleted symbol, all symbols rearranged above the deleted symbol and the symbol displayed in one of the capsules 211A to 211E which corresponds to the column area of the deleted symbol are scrolled downward (slid) together. As a result, a symbol is arranged again in the area corresponding to the selected and deleted symbol. In this regard, the symbol displayed in one of the capsules 211A to 211E which corresponds to the column area of the deleted symbol (i.e., the symbol displayed outside the symbol display area 21) becomes displayed in the symbol display area 21.

According to the arrangement above, when the deletion betting (further insertion of a credit) is performed, it becomes possible to freely select a symbol to be deleted from the symbols rearranged in the symbol display area 21. Then the selected symbol is deleted and the symbol displayed in one of the capsules 211A to 211E corresponding to the column area of the deleted symbol is arranged in the symbol display area 21. As a result, a payout is awarded based on the combination of the symbols displayed in the symbol display area again. This arrangement allows the player to consider which symbol should be selected and deleted to rearrange the symbols in order to form a combination with which a payout is awarded, with reference to the symbols displayed in the capsules 211A to 211E.

Other Embodiments

While the descriptions above deal with the slot game, the present invention can be applied to other games.

For example, the present invention is applicable to Blackjack which is a card game. In Blackjack, 2 cards are distributed to a player from a stack of playing cards which have been shuffled (equivalent to the symbol random determination process), and these two cards are displayed in a first display frame (equivalent to the symbol display area). Furthermore, one card randomly selected from the playing cards is displayed in a second display frame which is different from the first display frame in which the player's cards are displayed. Then either winning determination based on the player's cards (i.e., which pair of the cards, the player's cards or opponent's cards, is better is determined by comparison) or further picking of one card from the stack of the playing cards is selected, and such a selection is repeated. At this stage, when a predetermined condition (e.g., a win is achieved in random determination, the current time is a predetermined time, a further credit has been inserted, or a credit is inserted at this stage) is satisfied, the card displayed in the second display frame is added to the player's cards. When the card displayed in the second display frame is added to the player's cards, either winning determination based on the player's cards including the card displayed in the second display frame or further picking of one card from the stack of the playing cards is selected.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

What is claimed is:

1. An information processor, comprising:

a display;

a controller, which is programmed to cause to be displayed on the display an image including a symbol display area having a matrix in which symbols are rearrangeable; and a storage unit in which is stored a symbol random determination table in which the probability of rearrangement of each of the symbols is defined;

the controller being further programmed to execute, as a unit game, processes of:

(2a) randomly determining symbols to be displayed outside the symbol display area of the display;

(2b) displaying, outside the symbol display area of the display, the symbols determined in the process (2a);

(2c) randomly determining a combination of symbols which are to be rearranged in the symbol display area of the display, based on the symbol random determination table;

(2d) displaying, in the symbol display area of the display, the combination of the symbols determined in the process (2c);

(2e) when the combination of the symbols displayed in the symbol display area of the display satisfies a predetermined condition, rearranging a predetermined number of symbols out of the symbols displayed outside the symbol display area in the process (2b) in the symbol display area, in accordance with the satisfied predetermined condition; and (2f) after the process (2e), awarding a benefit in accordance with a combination of the symbols displayed in the symbol display area;

wherein the symbol display area is arranged so that columns and stages intersect with one another in a matrix arrangement and the controller is further programmed to execute a process in which, in the process (2b), the symbols determined in the process (2a) are displayed above the respective columns; the symbols are scrolled along the respective columns and rearranged in the respective columns in the process (2d); and if in the process (2e) the combination of the symbols rearranged in the symbol display area satisfies the predetermined condition, the symbols forming the combination satisfying the predetermined condition are deleted and all symbols rearranged above the deleted symbols and symbols displayed above the columns in which the deleted symbols are rearranged are moved downward in a sliding manner.

2. The information processor according to claim 1, wherein the controller is further programmed to execute a process of: when the combination of the symbols rearranged in the symbol display area in the process (2d) does not satisfy the predetermined condition, executing a next unit game except the processes (2a) and (2b), while the symbols displayed outside the symbol display area in the process (2b) are kept displayed.

3. The information processor according to claim 1, wherein, the symbols include first benefit symbols and second benefit symbols, a benefit corresponding to a combination of the first benefit symbols is less valuable than a benefit corresponding to a combination of the second benefit symbols, and the symbols which are selected to be displayed outside the symbol display area in the process (2a) are the second benefit symbols.

4. The information processor according to claim 1, wherein the controller is further programmed to execute a process of (2g) repeating the processes (2e) to (2f) until the combination of the symbols rearranged in the symbol display area no longer satisfies the predetermined condition.

5. An information processor, comprising:

a display;

a controller, which is programmed to cause to be displayed on the display an image including a symbol display area in which symbols are rearrangeable and in which columns and stages intersect with each other in a matrix manner; and a storage unit in which is stored a symbol random determination table in which the probability of rearrangement of each of the symbols is defined;

the controller being further programmed to execute, as a unit game, processes of:

(3a) randomly determining symbols to be displayed outside the symbol display area of the display;

(3b) displaying, above the respective columns, the symbols determined in the process (3a);

(3c) randomly determining a combination of symbols which are to be rearranged in the symbol display area of the display, based on the symbol random determination table;

(3d) scrolling the symbols along the respective columns and then rearranging, in the symbol display area of the display, the combination of the symbols determined in the process (3c) along the respective columns;

(3e) when a predetermined game condition is satisfied, causing a predetermined number of symbols corresponding to the predetermined game condition to be selectable out of the symbols rearranged in the symbol display area in the process (3d), deleting all of the selected symbols, and moving all symbols rearranged above the deleted symbols and symbols displayed above the columns in which the deleted symbols are rearranged, downward in a sliding manner; and (3f) after the process (3e), awarding a benefit in accordance with a combination of the symbols displayed in the symbol display area.

6. The information processor according to claim 5, wherein the controller is further programmed to execute a process of (3g) repeating the processes (3e) to (3f) until the predetermined game condition is no longer satisfied.

7. A game control method comprising the steps of:

(4a) causing to be displayed on a display an image including a symbol display area having a matrix in which symbols are rearrangeable;

(4b) randomly determining symbols to be displayed outside the symbol display area of the display;

(4c) displaying, outside the symbol display area of the display, the symbols determined in the process (4b);

(4d) determining a combination of symbols to be displayed in the symbol display area of the display;

(4e) displaying, in the symbol display area of the display, the combination of symbols determined in the process (4d);

(4f) when a predetermined condition is satisfied, displaying a predetermined number of symbols out of the symbols displayed outside the symbol display area in the process (4c) in the symbol display area, in accordance with the satisfied predetermined condition; and (4g) after the process (4f), awarding a benefit in accordance with a combination of the symbols displayed in the symbol display area;

wherein the symbol display area is arranged so that columns and stages intersect with one another in a matrix arrangement and the game control method further comprises a step in which, in the process (4c), the symbols determined in the process (4b) are displayed above the respective columns; the symbols are scrolled along the respective columns and rearranged in the respective columns in the process (4e); and if in the process (4f) the combination of the symbols rearranged in the symbol display area satisfies the predetermined condition, the symbols forming the combination satisfying the predetermined condition are deleted and all symbols rearranged above the deleted symbols and symbols displayed above the columns in which the deleted symbols are rearranged are moved downward in a sliding manner.

* * * * *